US005551933A

United States Patent [19]

Washburn

[11] Patent Number: 5,551,933

[45] Date of Patent: Sep. 3, 1996

[54] WRIST MOBILIZATION TREATMENT DEVICE AND METHOD

[75] Inventor: Caryl A. Washburn, Lewisville, Tex.

[73] Assignee: Applied Therapeutic Sciences, Inc., Southlake, Tex.

[21] Appl. No.: 383,731

[22] Filed: Feb. 3, 1995

[51] Int. Cl.[6] ..... A63B 23/16; A63H 33/00

[52] U.S. Cl. ..... 482/44; 446/489; 446/170

[58] Field of Search ..... 482/44, 45, 49, 482/148; 446/170, 489, 258; 273/119

[56] References Cited

U.S. PATENT DOCUMENTS

| | | | |
|---|---|---|---|
| 2,198,075 | 4/1940 | Borek | 446/170 |
| 3,306,612 | 2/1967 | Rosen | 482/44 |
| 3,578,329 | 5/1971 | Biedny | 273/119 |
| 4,869,492 | 9/1989 | Joutras | 482/44 |
| 5,112,268 | 5/1992 | Klaus | 446/489 |

OTHER PUBLICATIONS

Jux–A–Cisor Arm Exerciser, North Coast Medical, Inc. Catalogue, 1994.

Dexterciser, North Coast Medical, Inc. Catalogue, 1994.

*Primary Examiner*—Stephen R. Crow

*Attorney, Agent, or Firm*—George R. Schultz; Strasburger & Price LLP

[57] ABSTRACT

An exerciser for treating wrist injuries or conditions including carpal tunnel syndrome is formed by a handle attached to a track of continuous loops. A moveable bead on the track is maneuvered from one end of the track to the other by manipulating the exerciser preferable with the patient using only her wrist. The motion required to move the bead along the track is therapeutic for those suffering from wrist disorders including carpal tunnel syndrome. Additionally, the track is formed from a flexible material allowing the track to be moved between a compressed position for storage and travel and an expanded position for use.

14 Claims, 1 Drawing Sheet

WRIST MOBILIZATION TREATMENT DEVICE AND METHOD

TECHNICAL FIELD OF THE INVENTION

This invention relates to an exerciser to treat a variety of wrist conditions including carpal tunnel syndrome.

BACKGROUND OF THE INVENTION

Injuries to or conditions of the wrist can be difficult to treat because of the many different motions that must be taken into account. The wrist is capable of six different motions: flexion, extension, radial deviation, ulnar deviation, supination, and pronation. Treatment involving the wrist should involve all six motions to achieve full rotation. Numerous conditions or injuries require treatment by hand therapists, one of the most prevalent is carpal tunnel syndrome.

Carpal tunnel syndrome is a condition resulting from the compression of the median nerve within the carpal tunnel, characterized by disturbances of sensation in the area of the skin supplied by the median nerve, pain on sharp flexion of the wrist, edema of the fingers, tense and shiny skin, and atrophy of the thenar muscles. These symptoms are particularly prevalent in the first three fingers of the hand. The compression of the median nerve characterizing carpal tunnel syndrome can occur from prolonged repetitive activity involving the hands such as typing.

Treatment for wrist injuries including carpal tunnel syndrome can involve wearing a wrist brace or possibly surgery in addition to a regimen of exercises. Several devices have been marketed as exercisers for the treatment of wrist conditions or injuries that employ the maneuvering of an object around a track. These previous exercisers have suffered from a number of defects. First, the tracks are shaped Such that they do not require the use of all six wrist motions to navigate them and they contain straight or only mildly curved sections allowing the patient to use gravity to maneuver the bead instead of the wrist action, thereby significantly lessening the therapeutic effect. Secondly, the handles employed are not shaped to reduce the grip pressure needed to hold them and can require or encourage the patient to grip too tightly which can aggravate, not alleviate, the condition. Exercise regimens to relieve wrist conditions are often lengthy and require the patient to carry exercise equipment with them. The previous exercisers have been made of inflexible materials and due to their bulky nature are inconvenient to transport. The present invention provides an exercise device that is convenient to transport so that the patient will carry it with him and complete his exercise regimen.

A wire loop amusement game is described by U.S. Pat. No. 3,578,329 issued to L. Biedny on May 11, 1971. The game includes a handle, a wire track, a plurality of beads and a spring member adjacent to the handle and in contact with the beads. The purpose of the game is to move the beads one at a time from one end of the track to the other utilizing the spring member to supply the necessary force. The game is not designed to fully exercise the wrist and, therefore, does not teach the therapeutic motion Or apparatus required to treat wrist injuries, especially carpal tunnel syndrome. Additionally, even if used in such a manner as to maneuver the beads using the players wrist, the game is not suitable for treatment of carpal tunnel syndrome for numerous reasons.

First, the track of the game lies in a single plane and requires a planar forward and back repetitive movement of the wrist to manipulate the beads. This planar movement mimics the type of repetitive motion that can cause wrist injuries or conditions. Second, due to the linear nature of the track, the bead mainly uses gravity to move. This results in little wrist movement, and therefore, very little therapeutic benefit.

SUMMARY OF THE INVENTION

The invention is generally a hand held exerciser that uses a bead on a track, the track being formed into a continuous loop which is attached to a handle. The patient holds the handle in either hand and uses his wrist to maneuver the bead from one end of the track to the other. The track is formed into multiple continuous loops with no straight or mildly curved sections, forcing the patient to use his wrist and not gravity to maneuver the beads. While gravity in fact moves the beads no matter the shape of the track, linear or relatively straight portions in a track allow the patient to move the beads a significant distance with no movement of the wrist by maneuvering the bead to the top of the linear section and allowing it to fall the entire length of the section. A track of continuous loops with no linear or relatively straight portions forces the patient to continually move his wrist to move the bead. The continuous loops also force the patient to utilize the six wrist motions required to alleviate wrist ailments such as carpal tunnel syndrome.

The handle is designed to minimize the grip pressure required to hold it and to minimize the grip pressure required by the patient's first three fingers. The handle is convex and curves outwardly from one end to the other. This curvature allows the grip pressure to be concentrated in the little finger of the patient's hand instead of the fingers most affected by carpal tunnel syndrome. The handle is covered with a soft foam rubber, preferably neoprene rubber. The soft foam rubber further reduces the grip pressure required to manipulate the device.

The track itself is formed from a flexible material. This material allows the track to be expanded or compressed along an arc through the centers of the loops without damaging or permanently deforming the exerciser. The track is expanded when used, this allows the bead to move freely along the entire length of the track. Unlike previous exercisers, however, the invention can be compressed resulting in the invention being relatively flat instead of bulky. In the compressed or flat position the exerciser can easily be stored or packed in a briefcase or other container. This makes the invention more effective by encouraging the patient to take it to work or carry it with him in everyday situations or while traveling.

Other objects and features of the invention will become more readily apparent from the following detailed description when read in conjunction with the accompanying drawings.

DETAILED DESCRIPTION

Figure 1:
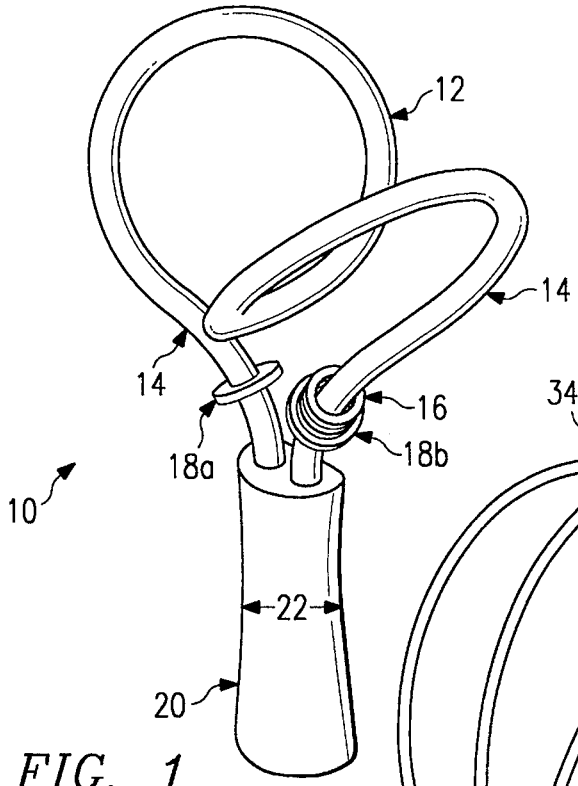
FIG. 1 (PRIOR ART)
FIG. 1 is perspective view of a prior an exerciser.

Referring now to FIG. 1, a prior an exerciser 10 is shown. Prior art exerciser 10 is formed by rigid track 12 connected to handle 20. Two stop washers 18*a* and 18*b* are fixed to rigid track 12 just above handle 20 stop moveable washers 16 once a complete circuit of rigid track 12 has been completed. Stop washers 18*a* and 18*b* are the same color in the prior art.

Prior art exerciser 10 suffers from all the problems discussed. Rigid track 12 is bulky and cannot be compressed or altered, thus preventing prior art exerciser 10 from being packed flat or easily transportable. Similarly, it cannot be adjusted. Rigid track 12 also has sections that are nearly straight or linear 14, allowing gravity to easily move washers 16 instead of forcing the patient to exercise her wrist through all six motions. Handle 20 of the prior art exerciser 10 is formed of a hard material possibly causing a discomfort when held by requiring excessive grip pressure to hold. Additionally, handle 20 has an inward or concave curvature shown by reference numeral 22, which forces the patient to exert more grip pressure to hold the exerciser, and more significantly, requires the grip pressure to come from the first three fingers of the patients hand, the fingers most affected by carpal tunnel syndrome.

Figure 2:
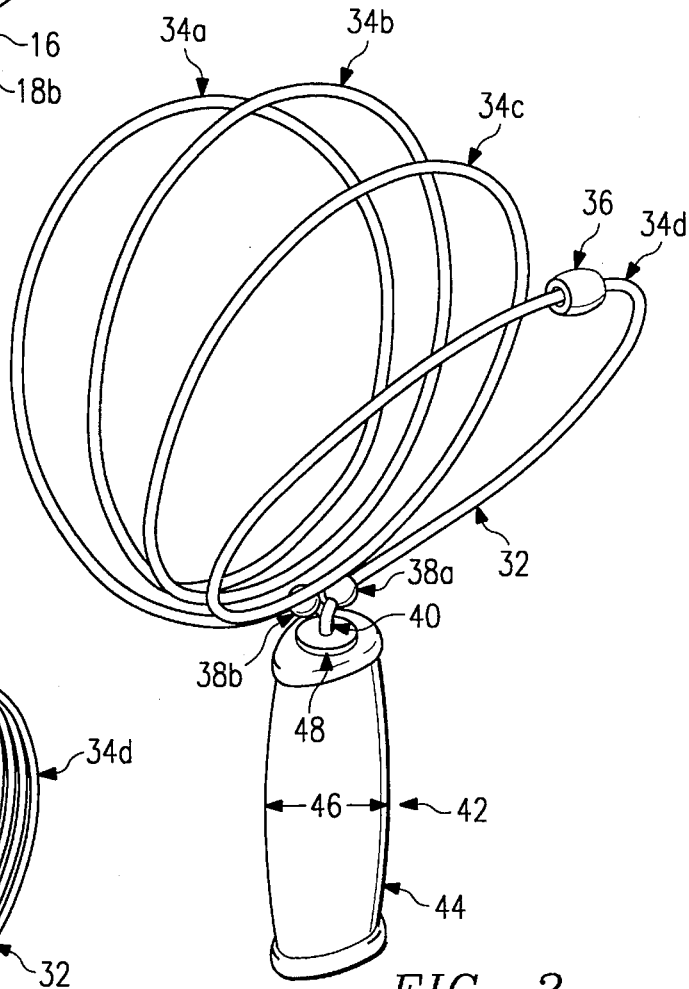
FIG. 2 is a perspective view of the exerciser with the loops in the expanded position.
Figure 3:
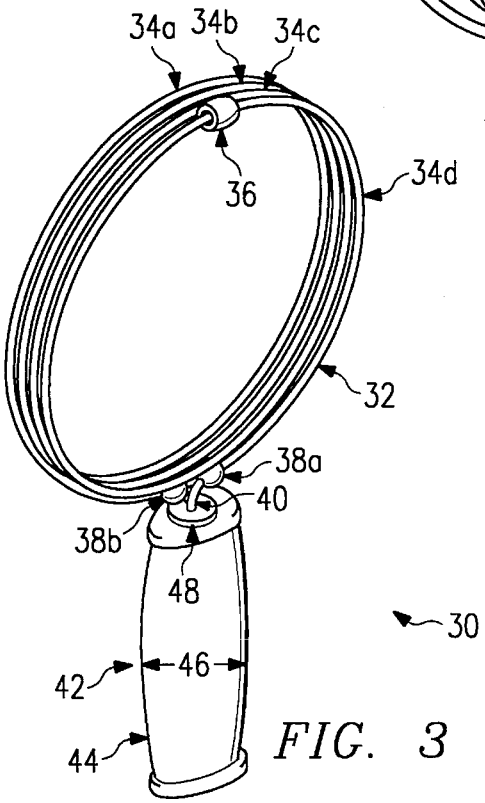
FIG. 3 is a perspective view of the exerciser with the loops in the compressed position.

Referring now to FIGS. 2 and 3, a description of the preferred embodiment of the present invention is given.

A wrist mobilization device indicated by reference numeral 30 includes handle 42 and flexible track 32. Track 32 is formed into a plurality of continuous loops 34*a–d*. Bead 36 is slidably disposed on track 32. Stop beads 38*a* and 38*b* are permanently fixed adjacent to each end 40 of track 32. The exact number of loops 34 is not important, but should preferably be more than three. The preferred embodiment shown in FIGS. 2 and 3 uses four continuous loops 34*a–d*. Each end of track 32 is attached to handle 42. Handle 42 is made of an inner core 48 surrounded by soft foam cover 44. Cover 44 is shaped to form a convex or outward curvature as shown by reference numeral 46. In the preferred embodiment cover 44 is neoprene foam rubber.

Bead 36 moves freely on track 32 and is designed to be maneuvered from one stop bead to the other. The bead 36 may be formed from any material such that it glides freely along track 32. In the preferred embodiment bead 36 is made of wood. The stop beads 38*a* and 38*b* are fixed at each end of track 32. The stop beads 38*a* and 38*b* are preferably different colors to allow the patient to distinguish them. The distinguishable stop beads 38*a* and 38*b* allow the patient to continue maneuvering bead 36 in the one direction along the track from one end to the other without forgetting which direction she was going. This is important because maneuvering bead 36 from one end of the track 32 to the other forces the patient's wrist through all six required motions of the wrist.

To maneuver bead 36 the patient holds handle 42 with the afflicted hand and using only that hand and wrist, manipulates exerciser 30 such that bead 36 proceeds along track 32 from one stop bead to the next. Once bead 36 reaches opposite stop bead 38*b* the patient reverses the motion manipulating exerciser 30 to maneuver bead 36 back to the opposite stop bead. This sequence is repeatable to extend throughout a treatment period.

Handle 42 is designed to be as easy as possible to grip by sufferers of wrist ailments including carpal tunnel syndrome. Handle 42 includes an outwardly curved section along its long axis as shown by reference numeral 46. This section is designed to minimize the grip pressure required to hold handle 42 of exerciser 30. An exerciser requiring excessive grip pressure to hold reduces the positive effect made by the therapeutic exercise.

In order to make exerciser 30 more portable, track 32, the bulkiest portion of exerciser 30, is formed of a flexible material that allows track 32 to be compressed by folding the outermost continuous loops shown in the preferred embodiment as 34*a* and d inward forming a flat profile as shown in FIG. 3. When the patient wishes to utilize exerciser 30, outermost continuous loops 34*a* and 34*d* are spread outward forming an angle up to 180° allowing bead 36 to move freely. In the preferred embodiment having four continuous loops 34*a–d* an angle between outside loops 34*a* and 34*b* of the full 180° is recommended for use although any angle that allows bead 36 to move freely can be used.

In the preferred embodiment flexible track 32 is formed from 6.0 gauge chrome tin alloy wire. The wire, after being formed into the continuous loops 34 is attached to handle 42 at inner core 48. Inner core 48 can be a wooden dowel. Track 32 is attached to handle 42 by insertion of the ends of the track into holes (not shown) in the dowel a distance sufficient to stabilize track 32. Epoxy or glue is used in the preferred embodiment to permanently affix track 32 to handle 42. Cover 44 is sized to fit snugly over inner core 48 and stay in place by the friction force between the dowel and the cover.

It should be understood that various modifications can be made to the embodiments disclosed without departing from the spirit and scope of the present invention. Various engineering changes and choices can also be made without departing substantially from the spirit of the disclosure.

I claim:

1. An exerciser for treating a wrist comprising:

a handle;

a track attached to said handle and having a first and second end wherein said track forms a plurality of continuous loops between said first end and said second end, said track being repeatedly adjustable between a first position which define an adjustable angle between said loops between 0° and 180° and a second position; and a bead slidably coupled to said track wherein said bead is maneuvered from first end to said second end by manipulating said wrist through all possible ranges of motion.

2. The exerciser of claim 1, wherein said plurality of continuous loops comprises at least three loops.

3. The exerciser of claim 1 wherein said plurality of continuous loops comprises four loops.

4. The exerciser of claim 1, said handle having a center, a first end and a second end, wherein said handle has an annular raised portion between said first and second ends.

5. The exerciser of claim 4, wherein said handle further comprises a soft foam cover.

6. The exerciser of claim 1 further comprising a first and second stop affixed to said first and second end of said track respectively, wherein first and second stop are different colors to provide a starting and a stopping point and to provide a method of tracking progress through an entire exercise cycle.

7. The exerciser of claim 1 wherein said track is formed from a chrome tin alloy wire.

8. An exerciser for treating a wrist comprising:

a handle;

a track attached to said handle, said track further comprising a plurality of continuous loops including a first outer loop and a second outer loop, wherein said first outer loop and said second outer loop define an angle, said angle being repeatedly deformable by bending said track wherein said angle is adjustable between 0° and 180°; and a bead having an aperture through which said track passes such that said bead is movably coupled to said track.

9. The exerciser of claim 8, said handle having a center, a first end and a second end, wherein said handle curves outward from said first and second end toward said center.

10. The exerciser of claim 8, wherein said handle further comprises a soft foam cover.

11. The exerciser of claim 8 further comprising a first and second stop bead affixed to said track wherein first and second stop bead are different colors wherein said first and second stop bead provide a starting and stopping point and said colors provide a method of tracking progress through an entire exercise cycle.

12. The exerciser of claim 8 wherein said track is formed from a chrome tin alloy wire.

13. The exerciser of claim 8 wherein said plurality of continuous loops comprises at least three loops.

14. The exerciser of claim 8 wherein said plurality of continuous loops comprises four loops.

* * * * *